United States Patent [19]

Carpenter, Jr. et al.

[11] Patent Number: 4,565,035

[45] Date of Patent: Jan. 21, 1986

[54] IMPELLER EVEN DISCHARGE APPARATUS

[75] Inventors: James H. Carpenter, Jr.; Ronald L. Mullins, both of Hagerstown, Md.

[73] Assignee: Kennecott Corporation, Cleveland, Ohio

[21] Appl. No.: 600,731

[22] Filed: Apr. 19, 1984

[51] Int. Cl.[4] ..... B24C 5/06

[52] U.S. Cl. ..... 51/434; 51/432

[58] Field of Search ..... 51/435, 434, 433, 432, 51/431, 410

[56] References Cited

U.S. PATENT DOCUMENTS 2,869,289 1/1959 Gossard ..... 51/434

3,683,556 8/1972 Leliaert ..... 51/435

3,785,105 1/1974 Freeman ..... 51/435

4,249,350 2/1981 Goff ..... 51/435

*Primary Examiner*—Frederick R. Schmidt

*Assistant Examiner*—Robert A. Rose

*Attorney, Agent, or Firm*—Porter & Bremer Co.

[57] ABSTRACT

A throwing wheel assembly for providing an even discharge of impact blast material along the face of a vane is disclosed herein. An impeller positioned in a non-parallel relationship to the outer impeller casing is also provided in a spatial relationship which aids in providing an even flow of impact blast material to the vanes. A deflector plate is provided for directing stray blast material onto the vanes.

7 Claims, 3 Drawing Figures

IMPELLER EVEN DISCHARGE APPARATUS

BACKGROUND OF THE INVENTION

1. Field of the Invention

This invention relates to an apparatus for providing an even discharge of impact blast material from a throwing wheel assembly and, more particularly, to an apparatus for providing an even pattern of discharge across the vanes of a throwing wheel assembly from an impeller internally disposed therein.

2. Description of the Prior Art

Throwing wheel assemblies of the type having a wheel or rotor with an attached impeller and a plurality of radially extending vanes arranged thereabout are generally well known. Typically, a feed spout is provided which supplies a flow of impact blast material to the impeller. The impeller is rotated, via the rotor, and the blast material is radially projected therefrom. The blast material is directed onto a plurality of radially extending vanes which, in turn, eject the blast material from the throwing wheel assembly at a predetermined velocity which is normally a function of the speed, i.e. revolutions per minute, of the rotor. The vanes are adapted to receive and throw the blast material from the periphery of the rotor through an appropriate discharge point in the machine casing to strip or clean metal castings or the like.

Due to the nature and overall configuration of the impeller and rotor, the impact blast material is directed to flow along the sidewalls of the vane which inherently provides increased abrasive wear therealong and greatly decreases the vane operating life. Typically, the blast material is discharged from the outer impeller casing in such a manner as to provide a transversely uneven flow across the face of the vanes. This uneven distribution of flow has been found to be a leading cause of excessive wear in the vanes. The known prior art, of which U.S. Pat. Nos. 3,242,615; 3,348,339; and 3,694,963 are exemplary, are directed to various configurations to shape the longitudinal blast pattern discharged from the vane. None are directed to forming an even transverse flow of blast material across the face of a vane but, rather, have merely been designed to direct or in some way alter the blast pattern emitted from the vane. Consequently, short vane operating life and excessive wear along known areas of the vane continue to exist.

SUMMARY OF THE INVENTION

The present inventive apparatus overcomes the aforementioned problems and effectively provides a configuration which promotes the even distribution of the impact blast material transversely over the width of the face of a plurality of vanes positioned within a throwing wheel assembly.

A primary object of the present invention is to increase the operating life of a throwing wheel assembly and the vanes used therein.

Another object of the present invention is to promote an even transverse distribution of impact blast material across the face of each vane.

The present invention provides a throwing wheel assembly with a machine casing having an internally disposed and rotatable rotor attached thereto. An impeller means, which includes an outer stationary impeller casing and an impeller which is attached to the rotor, is provided. The impeller has a directing means for directing the impact blast material from the outer impeller casing. A plurality of radially extending vanes are provided about the impeller casing. A feed spout for providing a flow of impact blast material to the impeller is connected to the machine casing. Finally, a deflecting means, attached to the rotor, is positioned to aid in the deflection of the material onto the plurality of vanes.

BRIEF DESCRIPTION OF THE DRAWINGS

The foregoing and other objects, advantages and characterizing features of the present invention will become clearly apparent from the ensuing detailed description of an illustrative embodiment thereof, taken together with the accompanying drawings wherein like reference numerals denote like parts throughout the various views and in which.

DETAILED DESCRIPTION OF THE PREFERRED EMBODIMENT

Figure 1:
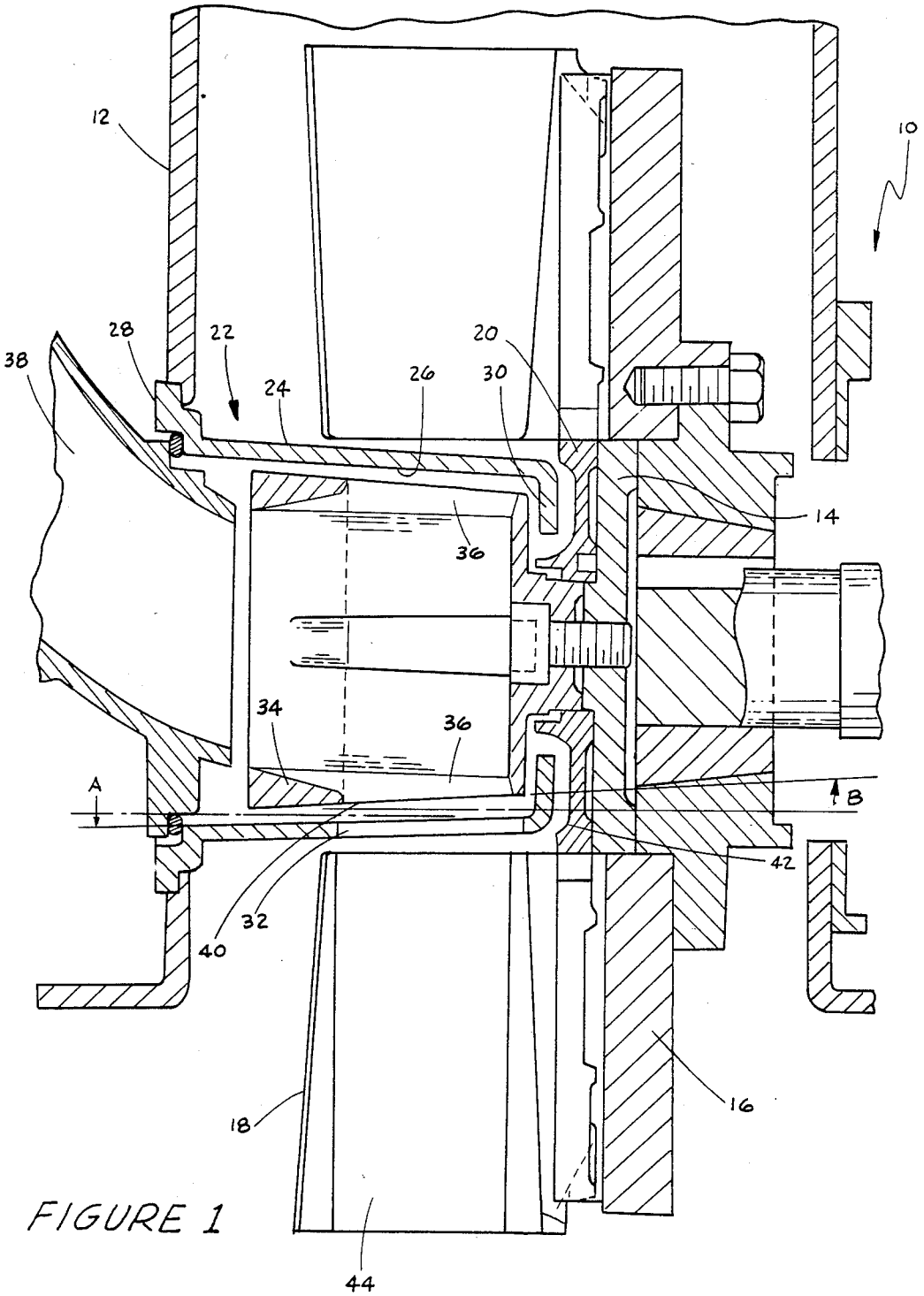
FIG. 1 is a sectional view of a throwing wheel assembly having a rotor and impeller according to the teachings of the present invention.

Referring now in detail to FIG. 1, there is shown a throwing wheel assembly 10, according to the teachings of the present invention, which has a machine casing 12 with a rotor 14 internally disposed therein. The rotor 14 is connected to a runnerhead portion 16 with the vanes 18 attached thereto by an appropriate affixing means. The rotor 14 further has a deflecting means or deflecting plate 20 attached thereto in such a manner as to be in close proximate spatial relationship to the runnerhead portion 16. Concentrically aligned with, and attached to the rotor 14, is impeller means 22 which includes an outer casing 24 having inner side walls 26 which are provided at one end with end flanges 28 which engage a portion of the machine casing 12 and through this engagement is stationarily affixed thereto. The other end of inner side walls 26 terminate in inwardly bent flanges 30. The side walls 26 are formed and positioned within the machine casing 12 in a non-parallel relationship to the longitudinal axis of the rotor 14. Specifically, the inner wall 26 of the outer casing 24 is formed preferably at an angle A to the longitudinal axis of the rotor 12. The preferred angle is $1\frac{1}{2}$°C. This is particularly shown in FIG. 1. Finally, the outer casing 24 is provided with a discharge opening 32 through which impact blast material can easily be ejected.

Concentrically and internally disposed within outer casing 24 is the impeller 34 which has a plurality of openings 36 positioned thereabout. The rotor 14 rotates the impeller 34 to cause impact blast material to be ejected through openings 36. A feed spout 38 is provided and is affixed to the machine casing 12 in any well known manner. The feed spout 38 provides a supply of impact blast material to the impeller 34. The impeller 34 is provided with an outer wall 40 having a directing means which is positioned and configured in a non-parallel relationship to inner wall 26 of the outer casing 24. As shown in FIG. 1, the outer wall 40 is set at an angle B to the longitudinal axis of the rotor 14. The preferred angle is 3°. This angular offset provides the directing means which directs the flow of impact blast material being ejected from the impeller 34 through the plurality of openings 36 through the space between the impeller 34, outer casing 24 and through opening 32 and onto the face 44 of vane 18. Of paramount importance is the relationship of the angle A to angle B, the preferred difference being $1\frac{1}{2}°$. Through much experimentation it has been found that by providing such an angular dfference of $1\frac{1}{2}°$ between the impeller outer wall 40 and the inner wall 26 of the outer casing 24, the impact blast material, upon flowing out of openings 36, is evenly dispersed through opening 32 and across the face 44 of vane 18 during the operation of throwing wheel assembly 10 as more fully described below.

Figure 2:
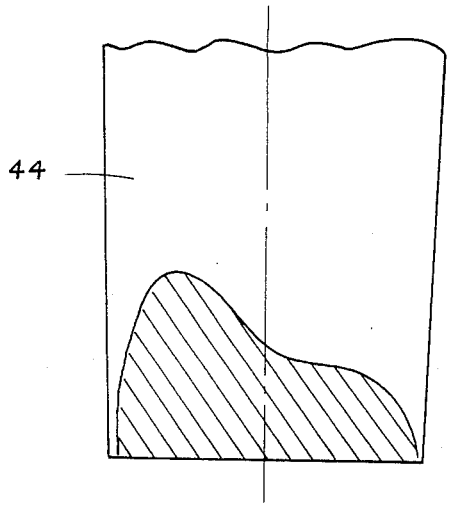
FIGURE 2 PRIOR ART
FIG. 2 is a graphical representation of the prior art abrasive distribution across the face of a vane.
Figure 3:
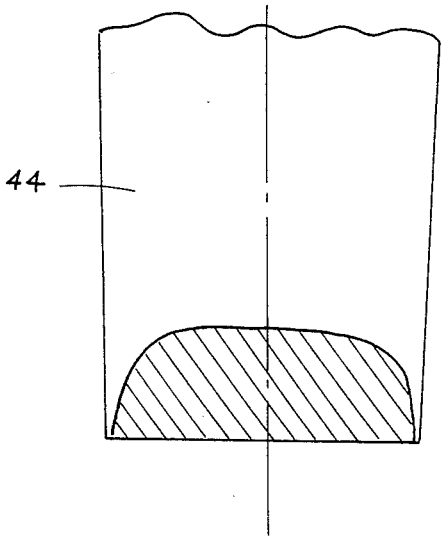
FIG. 3 is a graphical representation of the abrasive distribution across the face of a vane according to the teachings of the present invention.

FIG. 2 is a graphical representation of the abrasive distribution across the face 44 of a vane 18 in an assembly, typical of the prior art. As shown therein, the impact blast material tends to flow along a side of a vane 18 causing excessive wear therealong. FIG. 3 shows the abrasive distribution resulting from the operation of the present inventive apparatus as is more fully described hereinbelow.

In operation, impact blast material is fed into the impeller 34 via feed spout 38. The rotor 14 is actuated and rotates impeller 34 positioned within outer casing 24 which is stationarily affixed to machine casing 12. As the impeller 34 rotates, the impact blast material flows outwardly through openings 36. The blast material flows directly through discharge opening 32, formed in the outer casing 24, and subsequently onto the face 44 of vanes 18 as they are rotated thereabout. Any stray portion of impact blast material flows through openings 36 and is ejected between impeller 34 and outer casing 24 and, hence, flows around inwardly bent flanges 30.

As this stray material flows around inwardly bent flanges 30, it, in turn, flows past the deflecting means or deflector plate 20. The deflector plate 20 includes a contoured portion 42 which aids in directing the flow of the material onto the face 44 of a vane 18.

From the foregoing, it is apparent that the objects of the present invention have been fully accomplished. As a result of the present invention, a new and improved impeller even discharge apparatus has been disclosed herein. A preferred embodiment of the principles of this invention having been described and illustrated, it is to be realized that the same are not limited to the particular method and apparatus shown in the drawings, and that modifications thereof are contemplated and can be made without departing from the spirit and scope of this invention as defined in the appended claims.

What is claimed is:

1. A throwing wheel assembly for throwing impact blast media at high speed, comprising:

a rotor, the rotor being rotatable about a longitudinal axis;

a plurality of radially extending vanes connected to the rotor for rotation therewith, the vanes each having a radially innermost portion spaced a predetermined distance from the longitudinal axis of the rotor so as to define an opening centered around said longitudinal axis;

a generally frusto-conical impeller connected to the rotor for rotation therewith, the impeller being disposed within the opening defined by the vanes and centered about said longitudinal axis, the impeller being adapted to receive impact blast media therein, the impeller including a circumferentially extending outer wall having a radially extending opening through which impact blast media can be directed;

a generally frusto-conical casing concentrically disposed within the opening defined by the vanes and about the impeller, the casing including a circumferentially extending inner wall in proximity with the outer wall of the impeller, the inner wall having a radially extending opening through which impact blast media received from the impeller can be directed onto the vanes;

a feed spout attached to said housing in spaced relation to said impeller; and the outer wall of the impeller and the inner wall of the casing being disposed in a non-parallel relationship, the outer wall of the impeller and the inner wall of the casing being positioned closest to each other adjacent said feed support.

2. The throwing wheel assembly of claim 1, wherein impact blast media is introduced into the impeller at a location remote from the rotor.

3. The throwing wheel assembly of claim 1, wherein the outer wall of the impeller and the inner wall of the casing diverge at an angle of $1\frac{1}{2}$ degrees.

4. The throwing wheel assembly of claim 3, wherein the inner wall of the casing is positioned at an angle of $1\frac{1}{2}$ degrees relative to the longitudinal axis of the rotor, and the outer wall of the impeller is positioned at an angle of 3 degrees relative to the longitudinal axis of the rotor.

5. The throwing wheel assembly of claim 1, further including a deflector connected to the rotor for rotation therewith, the deflector being disposed within the opening defined by the vanes and adjacent that end of the casing positioned closest to the rotor, the deflector including a portion inclined at an angle relative to the longitudinal axis of the rotor such that stray impact blast media is directed toward the vanes.

6. The throwing wheel assembly of claim 5, further including a flange connected to the end of the casing at that end of the casing positioned closest to the rotor, the flange extending radially inwardly at an axial location intermediate the impeller and the deflector.

7. An impeller for use in a throwing wheel assembly, comprising:

a generally frusto-conical body portion having first and second ends, a longitudinal axis, and an outer wall positioned at an angle of 3 degrees relative to the longitudinal axis;

a radially extending opening in the body portion;

an end wall closing the first end of the body portion, the second end of the body portion being open; and the outer wall being closest to the longitudinal axis adjacent the intersection of the outer wall with the end wall, the outer wall being furthest from the longitudinal axis at the second end of the body portion.

* * * * *

UNITED STATES PATENT AND TRADEMARK OFFICE

CERTIFICATE OF CORRECTION

PATENT NO. : 4,565,035

DATED : January 21, 1986

INVENTOR(S) : James H. Carpenter, Jr.; Ronald L. Mullins

It is certified that error appears in the above-identified patent and that said Letters Patent are hereby corrected as shown below:

Column 2, line 50 - "1½°C" should be "1½ degrees"

Column 4, line 22 - "support" should be "spout"

Signed and Sealed this

*Sixth* Day of *May 1986*

[SEAL]

*Attest:*

DONALD J. QUIGG

*Attesting Officer*

*Commissioner of Patents and Trademarks*